US012070167B2

(12) United States Patent
Rossi

(10) Patent No.: US 12,070,167 B2
(45) Date of Patent: Aug. 27, 2024

(54) DISPENSING UNIT

(71) Applicant: GFL S.A., Lugano (CH)

(72) Inventor: Luigi Rossi, Lugano (CH)

(73) Assignee: GFL S.A., Lugano (CH)

( * ) Notice: Subject to any disclaimer, the term of this patent is extended or adjusted under 35 U.S.C. 154(b) by 462 days.

(21) Appl. No.: 17/297,646

(22) PCT Filed: Nov. 27, 2019

(86) PCT No.: PCT/IB2019/060234
§ 371 (c)(1),
(2) Date: May 27, 2021

(87) PCT Pub. No.: WO2020/110033
PCT Pub. Date: Jun. 4, 2020

(65) Prior Publication Data

US 2022/0007897 A1 Jan. 13, 2022

(30) Foreign Application Priority Data

Nov. 29, 2018 (IT) ..... 102018000010692

(51) Int. Cl.
*A47K 5/12* (2006.01)
*B65D 1/02* (2006.01)

(52) U.S. Cl.
CPC ..... *A47K 5/1205* (2013.01); *B65D 1/0276* (2013.01); *A47K 2201/00* (2013.01); *A47K 2201/02* (2013.01); *A47K 2201/025* (2013.01); *B65D 2501/0081* (2013.01)

(58) Field of Classification Search
CPC ..... A47K 5/1205; A47K 2201/02; A47K 2201/00; B65D 1/0276; B65D 2501/0081
USPC ..... 222/181.3; 248/222.11–222.12
See application file for complete search history.

(56) References Cited

U.S. PATENT DOCUMENTS 3,032,081 A * 5/1962 La Cotta ..... B65D 83/388 222/394
4,582,227 A 4/1986 Kanfer
4,651,902 A * 3/1987 Hobbs ..... A47K 5/1211 222/153.09

(Continued)

FOREIGN PATENT DOCUMENTS

CN 102083351 A 6/2011
CN 203987793 U 12/2014

(Continued)

OTHER PUBLICATIONS

International Search Report for International Patent Application No. PCT/IB2019/060234, mailed Jun. 30, 2020, 22 Pages.

(Continued)

*Primary Examiner* — Paul R Durand
*Assistant Examiner* — Randall A Gruby
(74) *Attorney, Agent, or Firm* — Armstrong Teasdale LLP

(57) ABSTRACT

A dispensing unit has a wall-mountable support device and a dispenser. The support device has a mounting body having a foot from which an engagement projection protrudes, a covering body having a gripping portion with a collar engageable with the dispenser, and security means suitable for forming a snap-engagement between the covering body and the mounting body. The engagement projection has a predefined configuration for univocally coupling with a bottom of a bottle of the dispenser.

8 Claims, 12 Drawing Sheets

(56) References Cited

U.S. PATENT DOCUMENTS

| | | | | | |
|---|---|---|---|---|---|
| 4,874,113 | A * | 10/1989 | Schmidt | A47K 5/12 | 222/143 |
| 5,277,332 | A * | 1/1994 | Rogers | A47K 5/12 | 221/96 |
| 5,435,511 | A * | 7/1995 | Hsu | F16M 11/041 | 403/374.2 |
| 5,971,335 | A | 10/1999 | Perrin et al. | | |
| 5,975,372 | A * | 11/1999 | Heyn | A47K 5/122 | 222/212 |
| 6,041,974 | A * | 3/2000 | Poitras | A47K 5/12 | 222/173 |
| 6,318,600 | B1 * | 11/2001 | Winnett | B65D 83/386 | 222/402.1 |
| 6,637,707 | B1 * | 10/2003 | Gates | A47B 96/061 | 248/222.12 |
| 6,820,770 | B2 * | 11/2004 | Makino | A47K 5/12 | 248/154 |
| 7,232,045 | B2 * | 6/2007 | Ophardt | A47K 5/12 | 222/153.01 |
| 7,654,417 | B2 * | 2/2010 | Rhodenbaugh | A47K 5/12 | 222/153.09 |
| 8,893,929 | B2 * | 11/2014 | Geiberger | A47K 5/122 | 222/181.3 |
| 9,770,141 | B2 * | 9/2017 | Wegelin | A47K 5/1217 | |
| 10,039,423 | B2 * | 8/2018 | Schultz | A47K 5/1211 | |
| 10,342,391 | B2 * | 7/2019 | Beckerman | B05B 11/0054 | |
| D905,466 | S * | 12/2020 | Rossi | D6/545 | |
| D906,007 | S * | 12/2020 | Rossi | D6/545 | |
| D918,017 | S * | 5/2021 | Park | D8/349 | |
| 11,464,368 | B2 * | 10/2022 | Kilic | B05B 11/0038 | |
| D1,002,387 | S * | 10/2023 | Caldwell | D9/545 | |
| 11,857,126 | B2 * | 1/2024 | Bing | A47K 5/1205 | |
| 2003/0132248 | A1 | 7/2003 | Gugliotti et al. | | |
| 2004/0108337 | A1 | 6/2004 | Makino et al. | | |
| 2005/0017146 | A1 | 1/2005 | Kringel et al. | | |
| 2011/0259920 | A1 | 10/2011 | Rennie et al. | | |
| 2012/0181405 | A1 * | 7/2012 | Zlatic | F16M 13/022 | 29/525.08 |
| 2012/0199609 | A1 * | 8/2012 | Schwenkenberg | A47K 5/122 | 222/181.3 |
| 2013/0098941 | A1 | 4/2013 | Wegelin | | |
| 2014/0203045 | A1 | 7/2014 | Mann et al. | | |
| 2016/0040455 | A1 * | 2/2016 | Limbert | G08B 21/245 | 222/153.09 |
| 2018/0153354 | A1 | 6/2018 | Beckerman | | |
| 2020/0029748 | A1 * | 1/2020 | Bradley | A47K 5/12 | |

FOREIGN PATENT DOCUMENTS

| | | | |
|---|---|---|---|
| CN | 204931520 | A | 1/2016 |
| CN | 108497975 | A | 9/2018 |
| WO | 2008028608 | A1 | 3/2008 |
| WO | 2016161318 | A1 | 10/2016 |
| WO | 2018038686 | A1 | 3/2018 |
| WO | 2018069544 | A1 | 4/2018 |

OTHER PUBLICATIONS

Communication pursuant to Article 94(3) EPC in corresponding EP Patent Application No. 19801414.6, mailed Jan. 3, 2024, 5 pages.
Office Action in corresponding CN Patent Application No. 201980079325.4, mailed Mar. 28, 2022, and English translation thereof, 12 pages total.
Third Party Observation submitted in related EP Patent Application No. 20190817414, submitted May 14, 2024, 7 pages.

* cited by examiner

DISPENSING UNIT

CROSS-REFERENCE TO RELATED APPLICATIONS

This application is a National Stage Application of International Patent Application No. PCT/IB2019/060234, having an International Filing Date of Nov. 27, 2019, which claims the benefit of priority to Italian Patent Application No. 102018000010692, filed Nov. 29, 2018, the entire contents of which are hereby incorporated by reference herein.

FIELD OF THE INVENTION

The subject of the present invention is a dispensing unit for fluid products, such as liquid soaps for shower or bath, shampoos, body creams and the like.

In particular, the subject of the present invention is a dispensing unit formed of a manually operated dispenser and a support device intended to be mounted to the wall and suitable to support the dispenser, provided with security means to prevent the unlawful removable of the dispenser.

BACKGROUND OF THE INVENTION

These dispensing groups are particularly widespread in the hotel sector, as they allow staff to replace the empty dispenser with a new dispenser and at the same time prevent the dispenser from being unlawfully removed, for example by guests.

However, the security means usually provided for are often insufficient, so that the dispenser is often unlawfully removed all the same.

SUMMARY OF THE INVENTION

The object of the present invention is to construct a dispenser unit that satisfies the requirements of the field and overcomes the drawbacks mentioned in reference to the prior art.

This object is achieved by a dispensing unit as described and claimed herein. Advantageous embodiments of the present invention are also described.

BRIEF DESCRIPTION OF THE DRAWINGS

The features and advantages of the dispensing unit according to the present invention will be apparent from the description given below, provided by way of non-limiting example, in accordance with the accompanying figures, wherein.

DETAILED DESCRIPTION

Figures 1A, 1B, 1C:
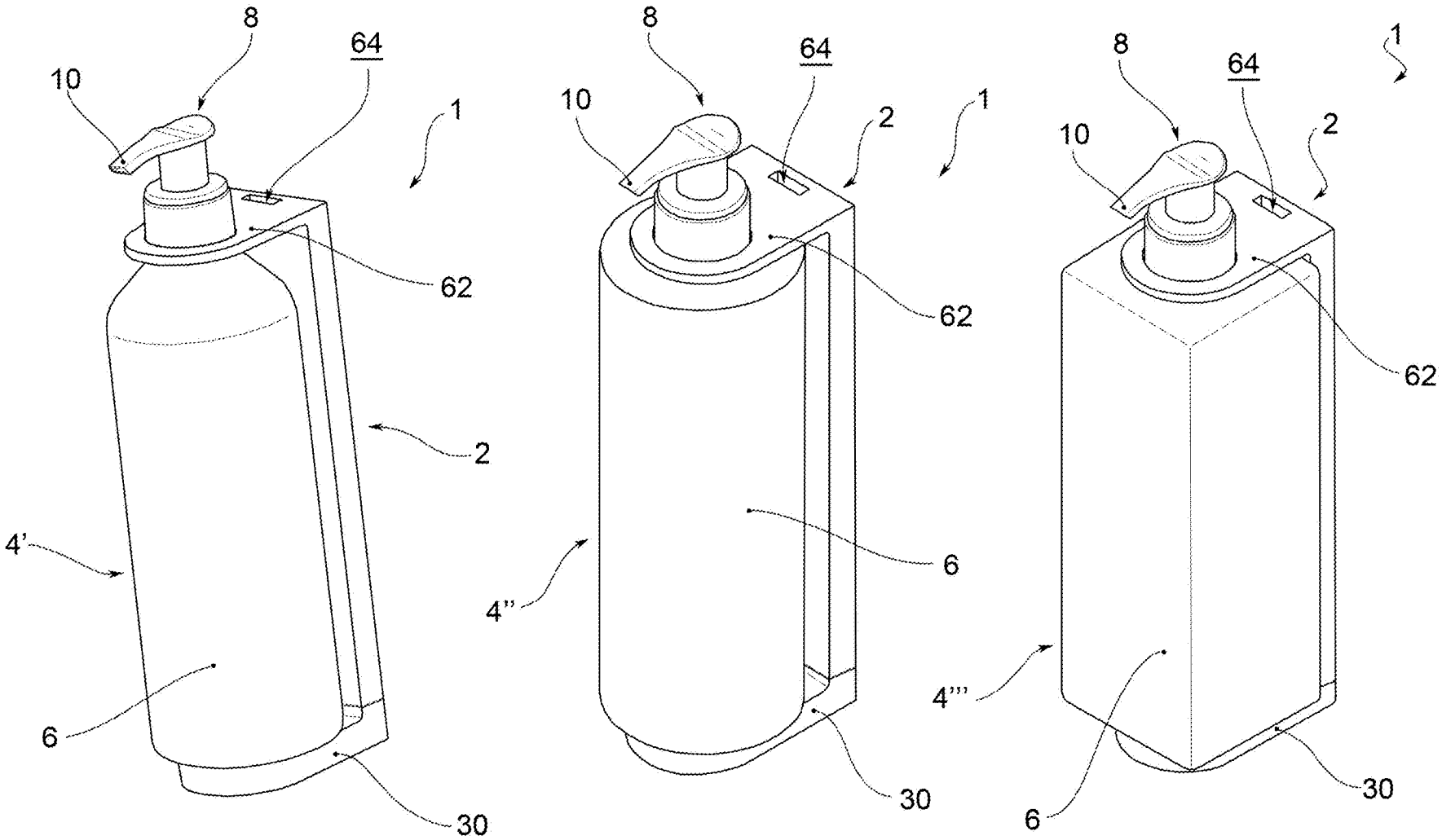
FIGS. 1*a*, 1*b* and 1*c* depict some embodiments of a dispensing unit according to the present invention.
Figure 1E:
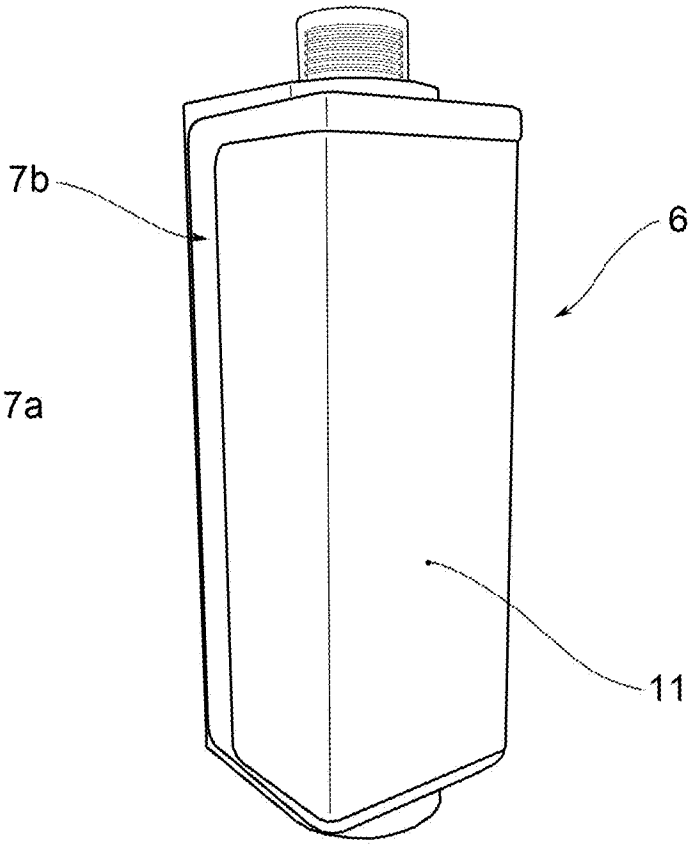
FIG. 1*e* illustrates a dispensing unit according to an embodiment of the present invention, wherein the bottle is provided with a label.
Figure 1D:
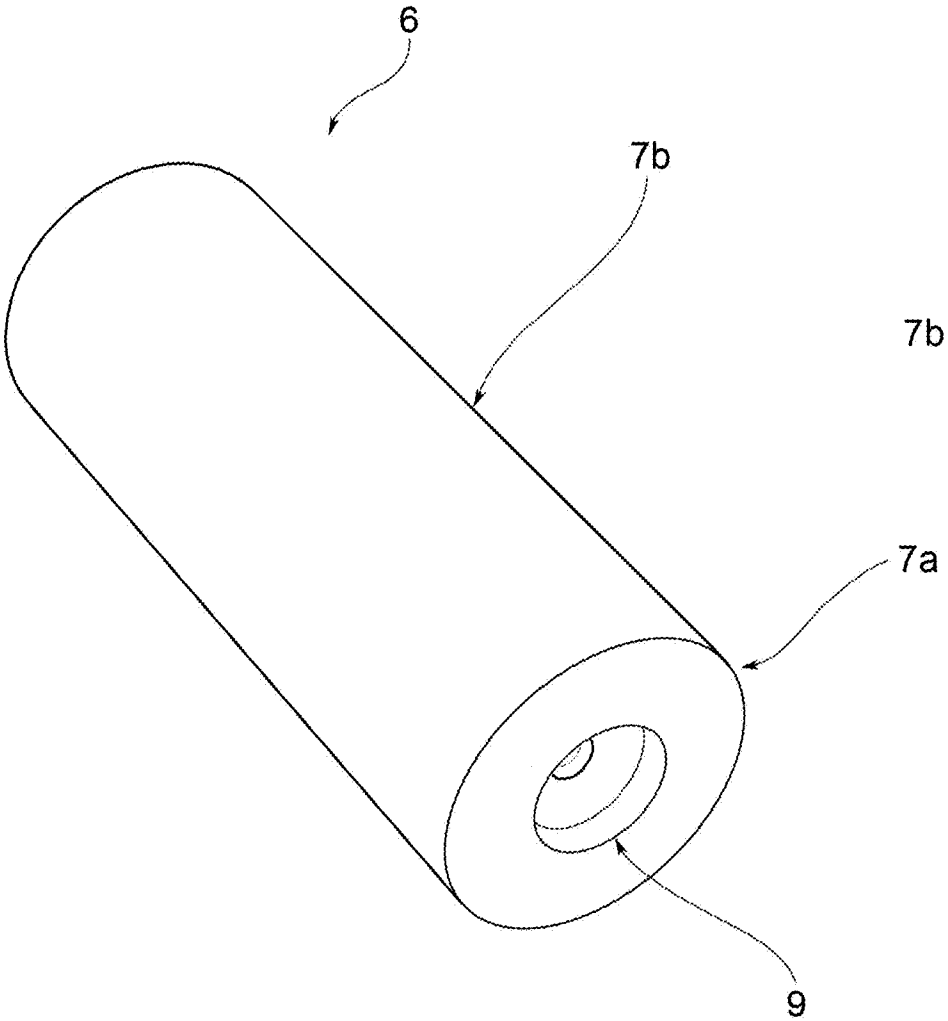
FIG. 1*d* represents a bottom of a bottle of a dispenser of the dispensing unit according to the present invention.

With reference to the accompanying figures, a dispensing unit is indicated collectively at 1 comprising a support device 2 suitable to be mounted to the wall, for example by screws or with double-sided adhesive tape, and a dispenser 4', 4", 4''' supported by the support device 2 and separable therefrom.

The dispenser 4', 4", 4''' comprises a bottle 6, e.g. circular or quadrangular in shape, and a dispensing head 8 applied to the bottle 6 in an engagement region, e.g. by threaded or bayonet attachment.

The dispensing head 8 is manually operable for dispensing the product contained in the bottle.

For example, the dispensing head 8 comprises a nozzle 10 which, manually lowered from an initial rest position, causes the product to be dispensed, and when released returns to the rest position.

The bottle 6 has a bottom 7*a* and a side wall 7*b*. In the bottom 7*a* a cavity 9 is obtained, which will be discussed hereinafter.

According to an embodiment, moreover, the bottle 6 comprises a label 11 applied to only one region of the side wall 7*b*; in other words, a further region of the side wall 7*b*, and in particular the one facing the wall to which the dispensing unit is mounted, does not have a label, so as to allow staff to verify the level of product contained, while this level is essentially hidden from the normal user.

In normal use of the dispensing unit, however, the label 11 is visible, so that the user may be informed about the contents of the bottle and the composition of the dispensable product. Furthermore, the entire bottle is visible, so as to be able to present various designs.

The support device 2 comprises a mounting body 20 and a covering body 22.

Figure 3B:
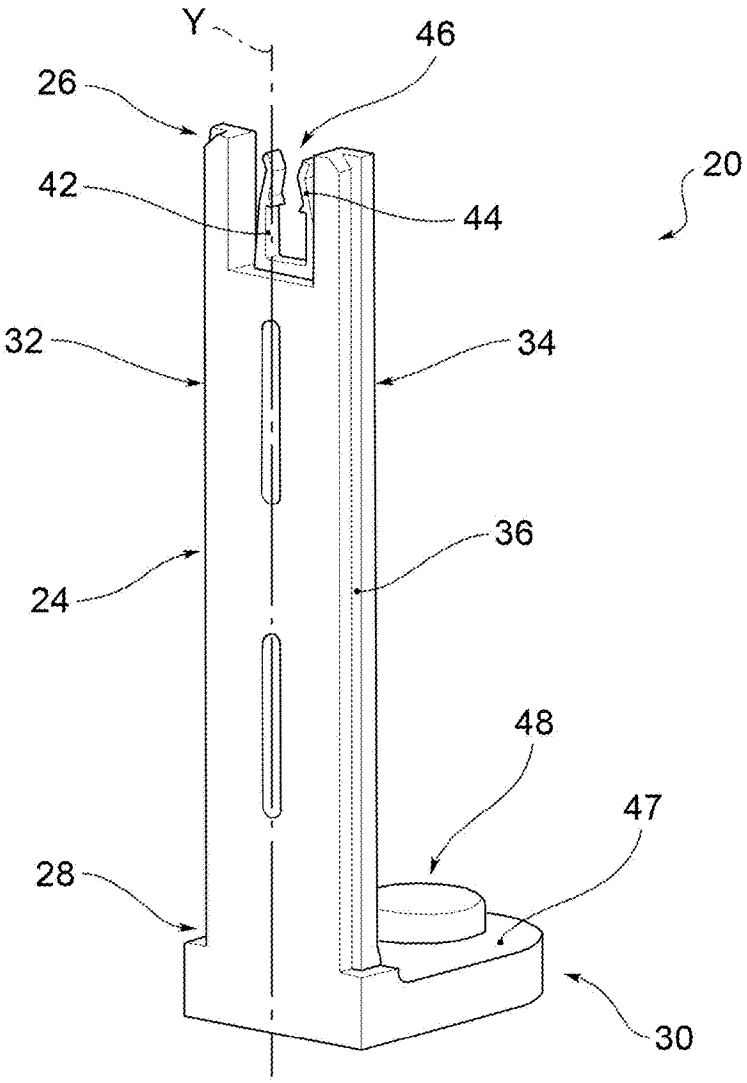
FIGS. 3*a* and 3*b* show a mounting body for the support device of FIGS. 2*a* and 2*b;*
Figure 3A:
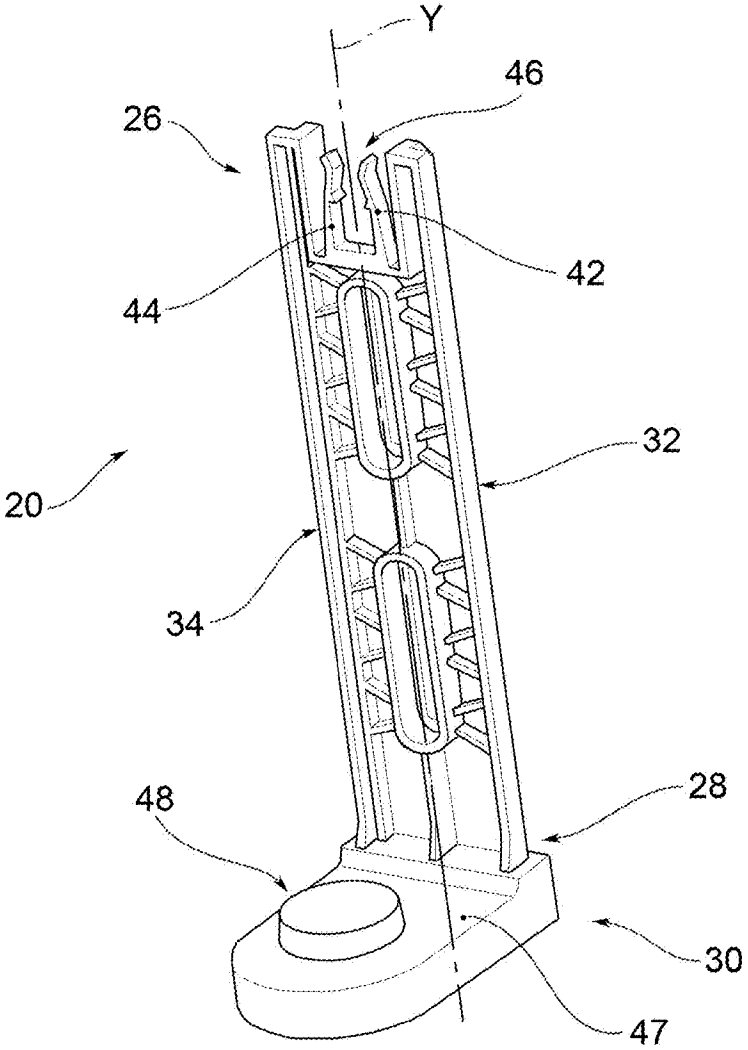

The mounting body 20 (FIGS. 3*a* and 3*b*) is substantially L-shaped and comprises a mounting plate 24, intended to be mounted to the wall, having a predominant extension along a vertical direction Y between an upper end 26 and a lower end 28, and a foot 30, protruding from the mounting plate 24 at the lower end 28 thereof.

Preferably, the mounting body 20 is made as a single piece out of plastic material, obtained by injection molding.

The mounting plate 24 has lateral sides 32,34 extending along the vertical direction in each of which there is obtained an undercut 36. Said undercuts 36 produce guide rails for coupling the mounting body 20 with the covering body 22.

The support device 2 further comprises hooking means configured to obtain a snap-engagement of the mounting body 20 with the covering body 22.

For example, said hooking means comprise a pair of flexible prongs 42, 44, arranged at the top end of the mounting plate 24; said prongs 42, 44 are suitably shaped at the free end to form a guide and form a fork 46.

The foot 30 comprises a substantially flat upper surface 47, and an engagement projection 48 protruding from the upper surface 47, configured for shape-coupling with the cavity 9 of the bottom 7*a* of the bottle 6.

According to a preferred embodiment, the engagement projection 48 is circular cylindrical in shape; according to other embodiments, the engagement projection is frustoconical or prismatic in shape, and thus also is the cavity 9. In any case, the cavity 9 of the bottom 7*a* of the bottle 6 and the engagement projection 48 of the foot 30 of the mounting body 20 form a shape-coupling so that the engagement projection 48 is insertable in the cavity 9.

The frustoconical shape is particularly advantageous, as it allows the bottle to be kept in the correct position during normal use by virtue of the friction between the surface of the cavity and that of the projection, and, at the same time, to be able to rotate the bottle to view the level of the remaining product.

Figure 4B:
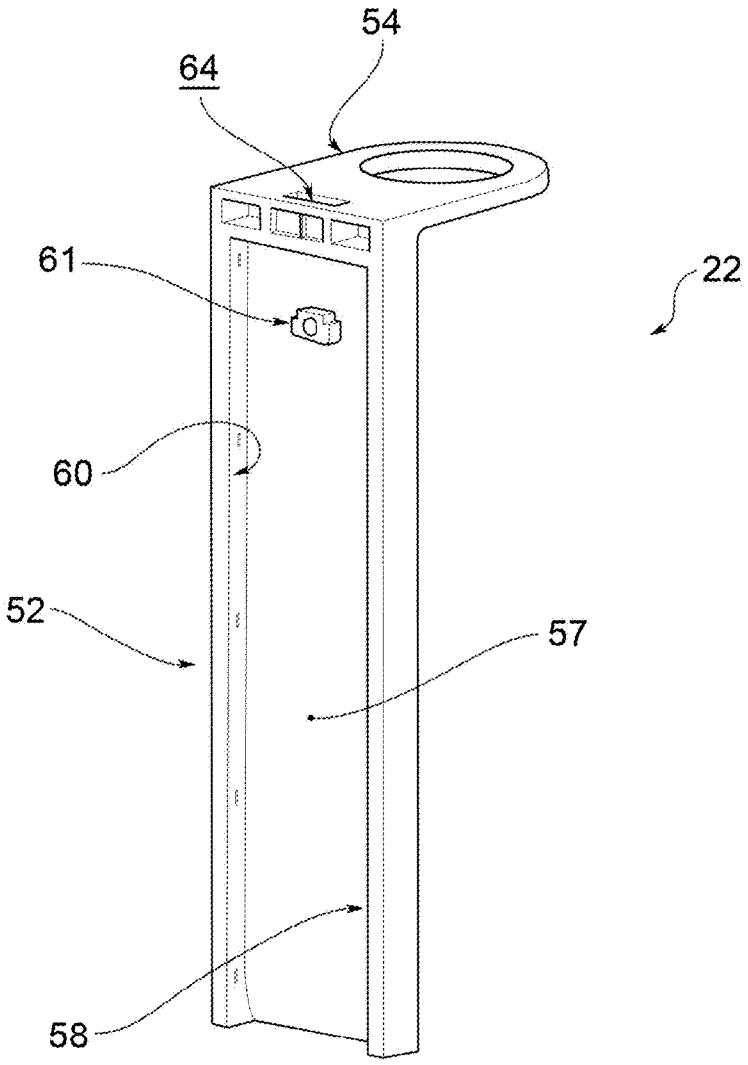
FIGS. 4*a* and 4*b* illustrate a covering body of the support device of FIGS. 2*a* and 2*b;*
Figure 4A:
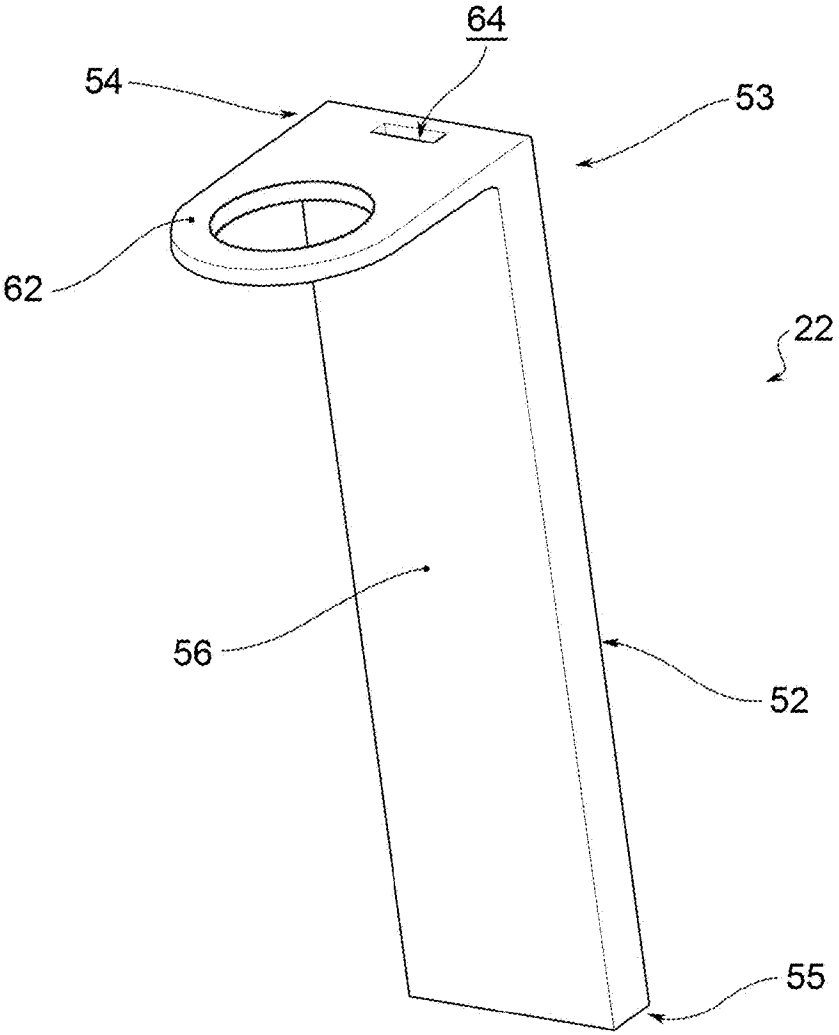

The covering body 22 (FIGS. 4*a* and 4*b*) is essentially L-shaped and comprises a covering portion 52 and a gripping portion 54.

The covering portion 52, which extends between an upper end 53 and a lower end 55, has a substantially flat front surface 56, configured to cover the mounting plate 24 when the covering body 22 is applied to the mounting body 20, and a back surface 57.

At the back, moreover, the covering portion 52 comprises a pair of side guides 58, 60 extending along the vertical direction Y, shaped to achieve a slidable engagement with the side panels 32, 34 of the mounting plate 24.

Moreover, the covering portion 52 comprises a hooking element 61, protruding from the rear surface 57, suitable to form a snap-engagement with the fork 46 of the mounting plate.

In other words, the hooking means comprise said hooking element 61.

The gripping portion 54 protrudes from the covering portion 52 at the top end 53.

Said gripping portion 54 comprises a gripping collar 62, which delimits a gripping opening 62*a* suitable for inserting the bottle 6 near the neck thereof or near the dispensing head 8.

Said gripping portion 54 also moreover has a key opening 64 which makes the rear part of the covering portion accessible from above.

In particular, said key opening 64 makes it possible to insert a security key suitable to deactivate the hooking means, i.e. suitable to disengage the fork 46 from the hooking element 61.

For the wall installation of the support device 2, the mounting plate 24 of the mounting body 20 is applied to the wall, typically by means of screws or anchors.

When the dispenser 4', 4", 4'" is arranged, moreover, the nozzle 10 is passed through the gripping collar 62 of the covering body 22.

Figure 2B:
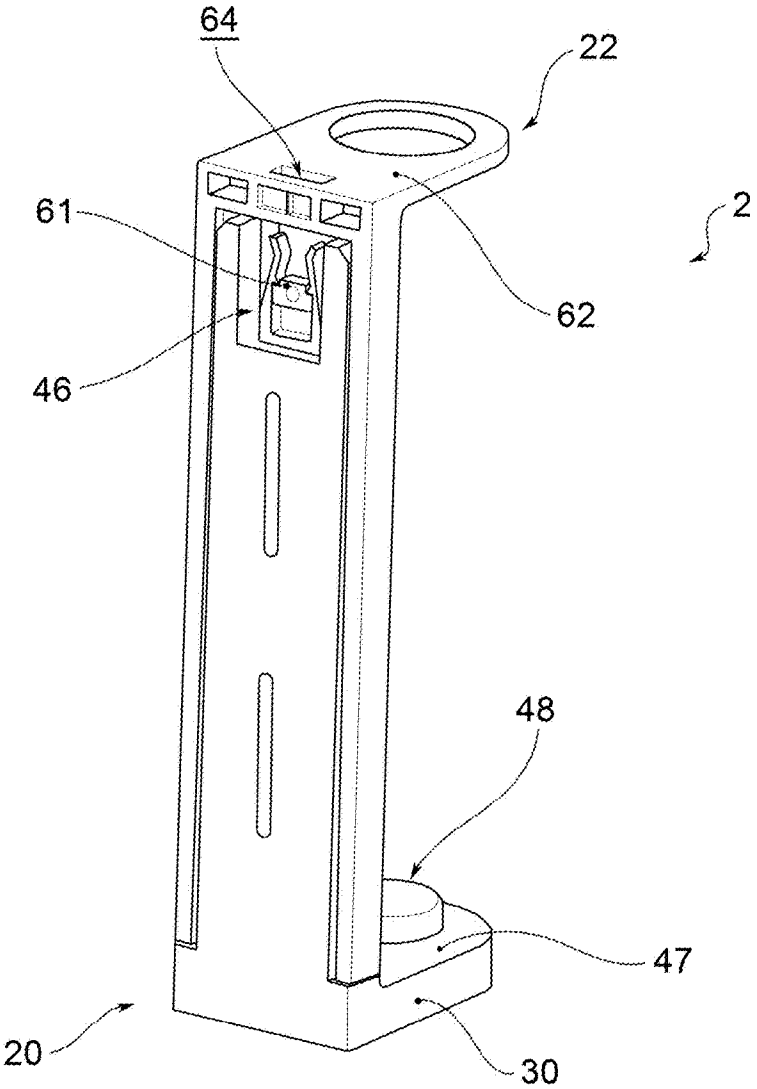
FIGS. 2*a* and 2*b* illustrate a support device for the dispensing unit according to the present invention.
Figure 2A:
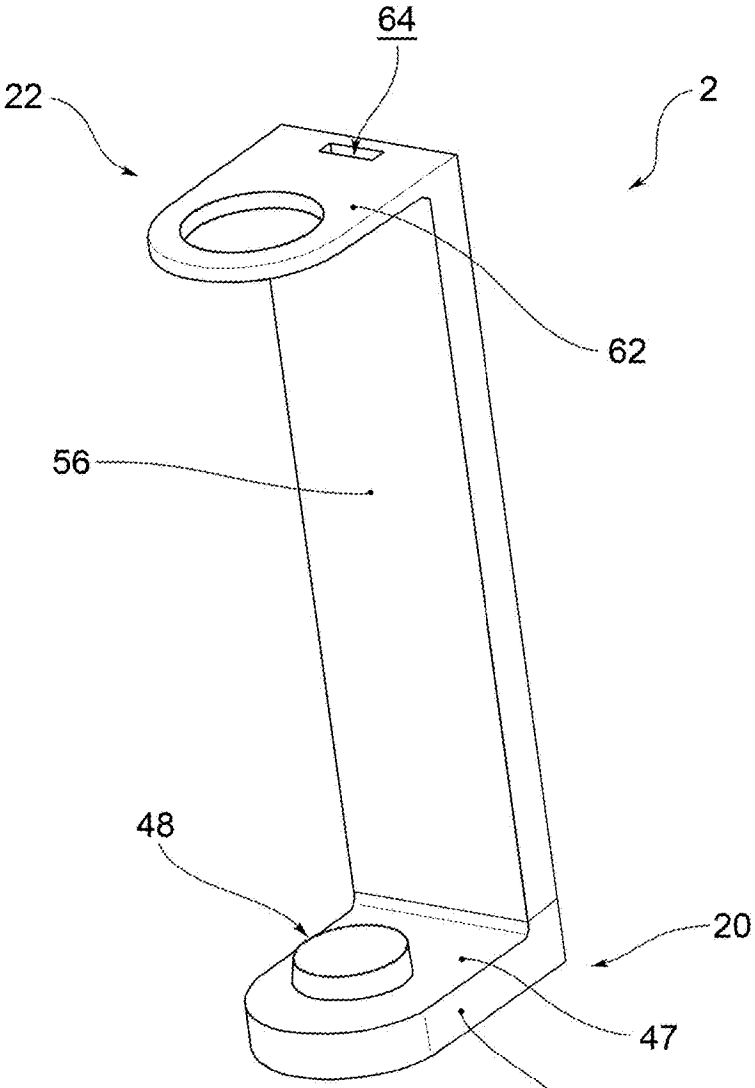

The covering body 22 is then slidable coupled with the mounting body 20 (in particular, the lateral guides 58, 60 of the covering body 22 slide along the lateral sides 32, 34 of the mounting body 20, until reaching an engagement configuration (FIGS. 2*a* and 2*b*) wherein the fork 46 is snap-engaged with the hooking element 61) and at the same time the bottom 7*a* of the bottle 6 is inserted on the engagement projection 48 of the foot 30 of the mounting body 20, so as to be accommodated in the cavity 9 of the bottom 7*a* of the bottle 6.

In other words, the bottle 6 is insertable vertically on the foot 30 of the mounting body 20, so that the engagement projection 48 is inserted vertically into the cavity 9 of the bottom 7*a* of the bottle 6.

According to a further embodiment of the invention (FIGS. 5*a* to 5*c*), the dispensing unit 1 comprises a security collar 100 applicable to the gripping collar 62 so as to cover at least partially the engagement region of the dispensing head 8 with the bottle 2.

Preferably, the security collar 100 is cup-shaped and comprises a cylindrical collar wall 102, a collar edge 104 protruding radially externally from a lower end 102*a* of the collar wall 102, and a collar crown 106 protruding radially internally from an upper end 102*b* of the collar wall 102.

The security collar 100 has a longitudinal split 108 which, in a predefined angular position, interrupts the annular continuity of the collar edge 104, the collar wall 102 and the collar crown 106.

The gripping opening 62*a* has, in a predefined angular position, a projection 110 suitable to couple with the split 108 of the security collar 100 so as to block the rotation of the security collar 100 inserted in the gripping opening 62*a*.

For the assembly of the dispensing unit, the security collar 100 is applied to the gripping collar 62 of the covering body 22; then the dispensing head 8 is inserted through the security collar 100, so that the engagement region is at least partially covered by the security collar 100; finally, the bottle 6 is positioned so that the engagement projection 48 is inserted in the cavity 9 and the covering body is coupled to the mounting body 20.

The security collar 100 is bound axially to the gripping collar 62 by virtue of the collar edge 104 and rotationally by virtue of the gripping projection 110 inserted in the split 108; the engagement area wherein the dispensing head is screwed or otherwise engaged with the bottle is therefore not accessible to a user.

Figure 5A:
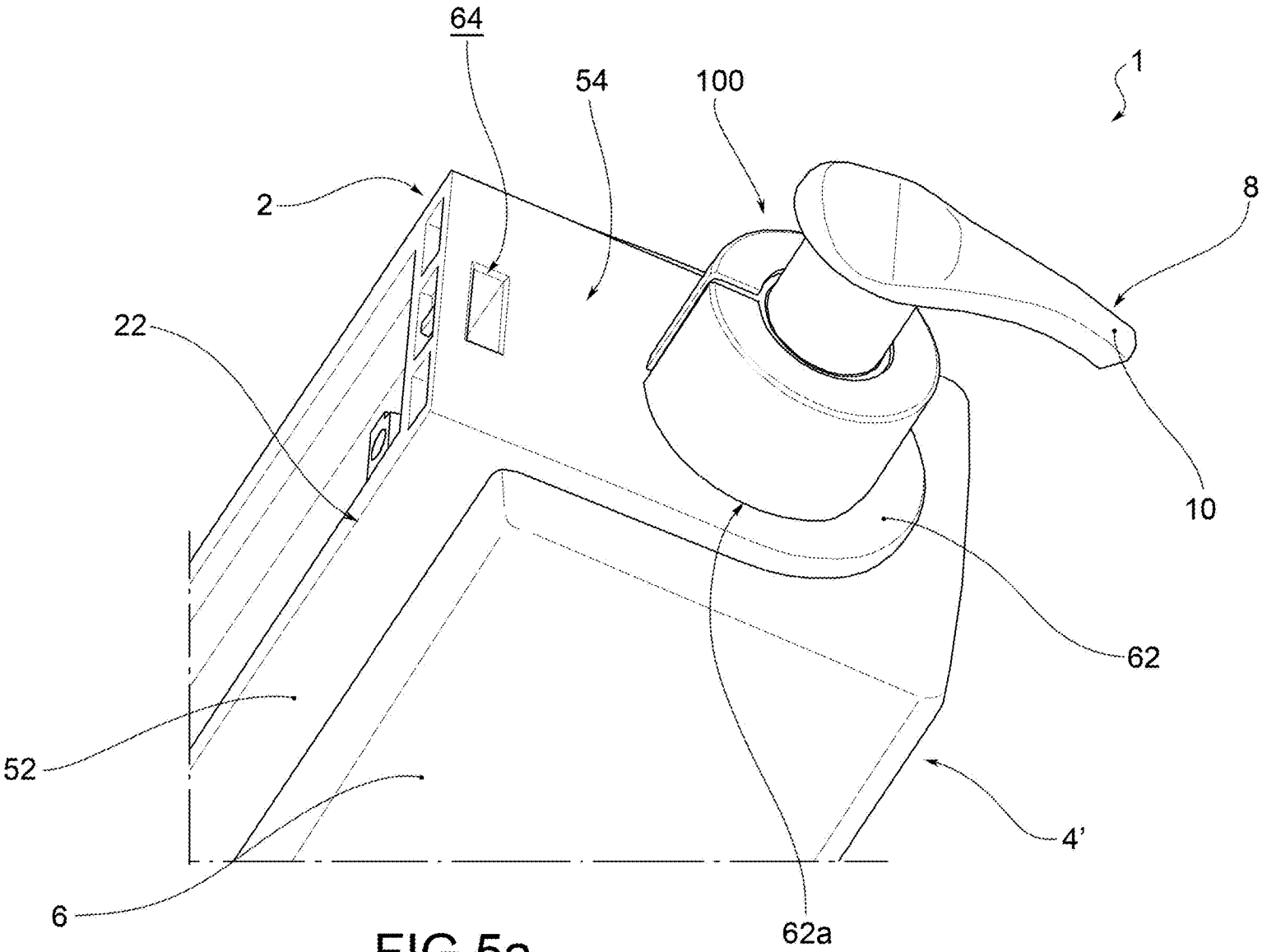
FIG. 5*a* illustrates the dispensing unit according to the present invention, in accordance with a further embodiment.
Figure 5B:
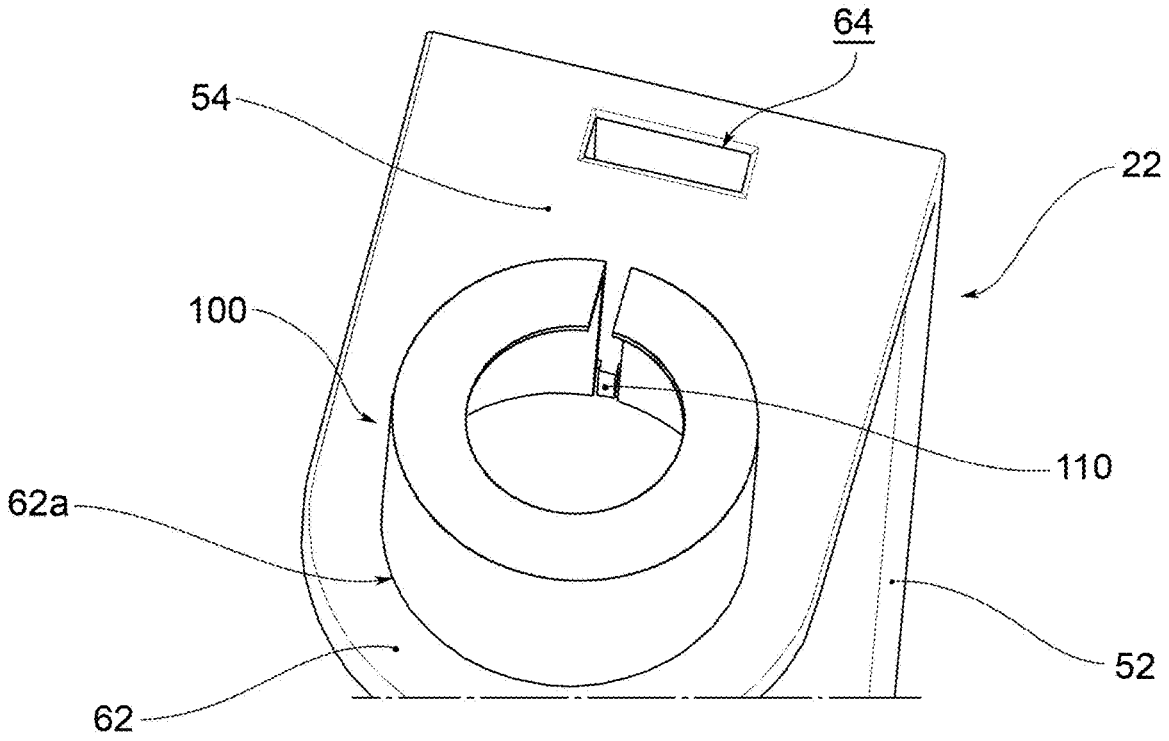
FIG. 5*b* illustrates an assembly consisting of a support device for the dispensing unit of FIG. 5*a* and a security collar.
Figure 5C:
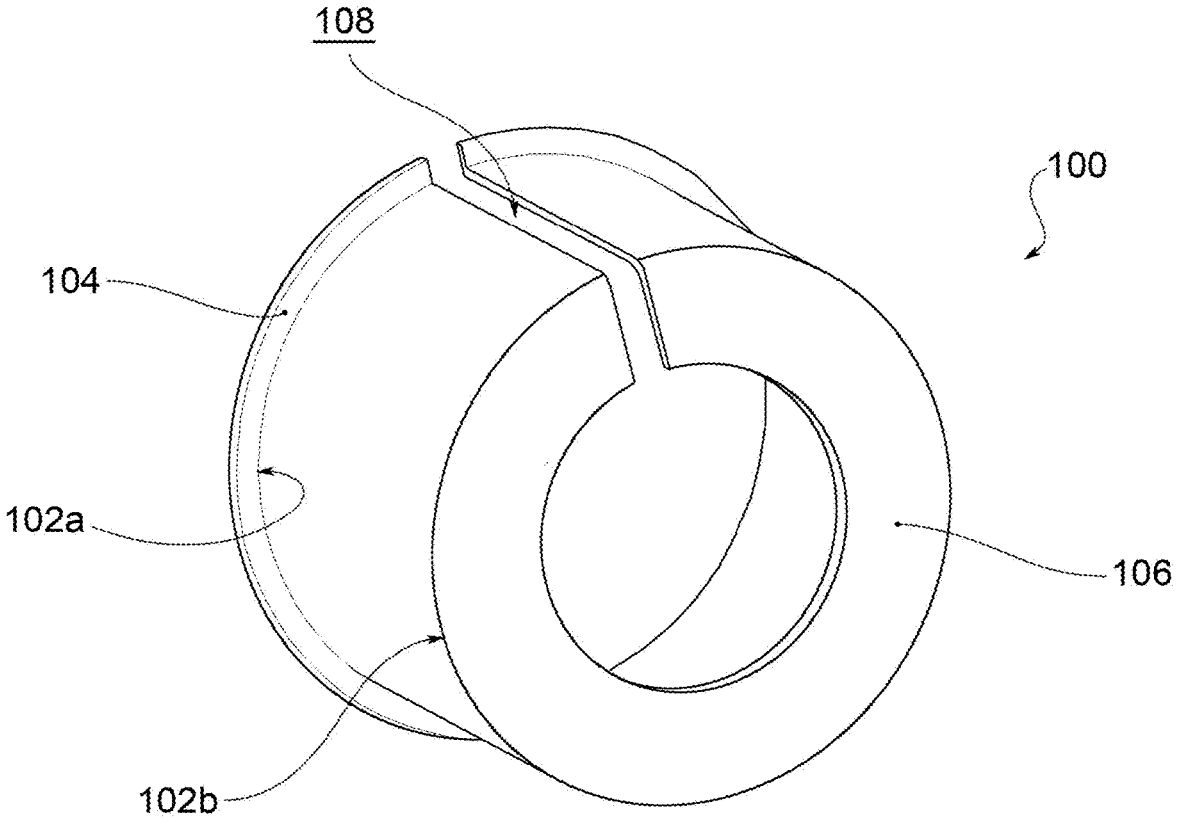
FIG. 5*c* represents the security collar of FIG. 5*b;*

According to a further embodiment (FIGS. 6*a* to 6*c*), the gripping projection 110 has a greater angular extension than in the embodiment mentioned with reference to FIGS. 5*a* to 5*c*, and correspondingly the split 108 of the security collar 100 is larger.

Preferably, moreover, the security collar 100 has a security projection 112 protruding from an upper surface 104*a* of the security edge 104; correspondingly, the gripping collar 62 has a gripping seat 114 obtained on a lower surface 62*b* of the gripping collar 62. The gripping seat 114 is suitable to accommodate the security projection 112.

According to a still further embodiment (FIGS. 7*a* to 7*d*), the security collar 100 has limited angular extension, and the security wall 102, the security edge 104 and the security crown 106 consist of cylindrical sectors.

Figure 6A:
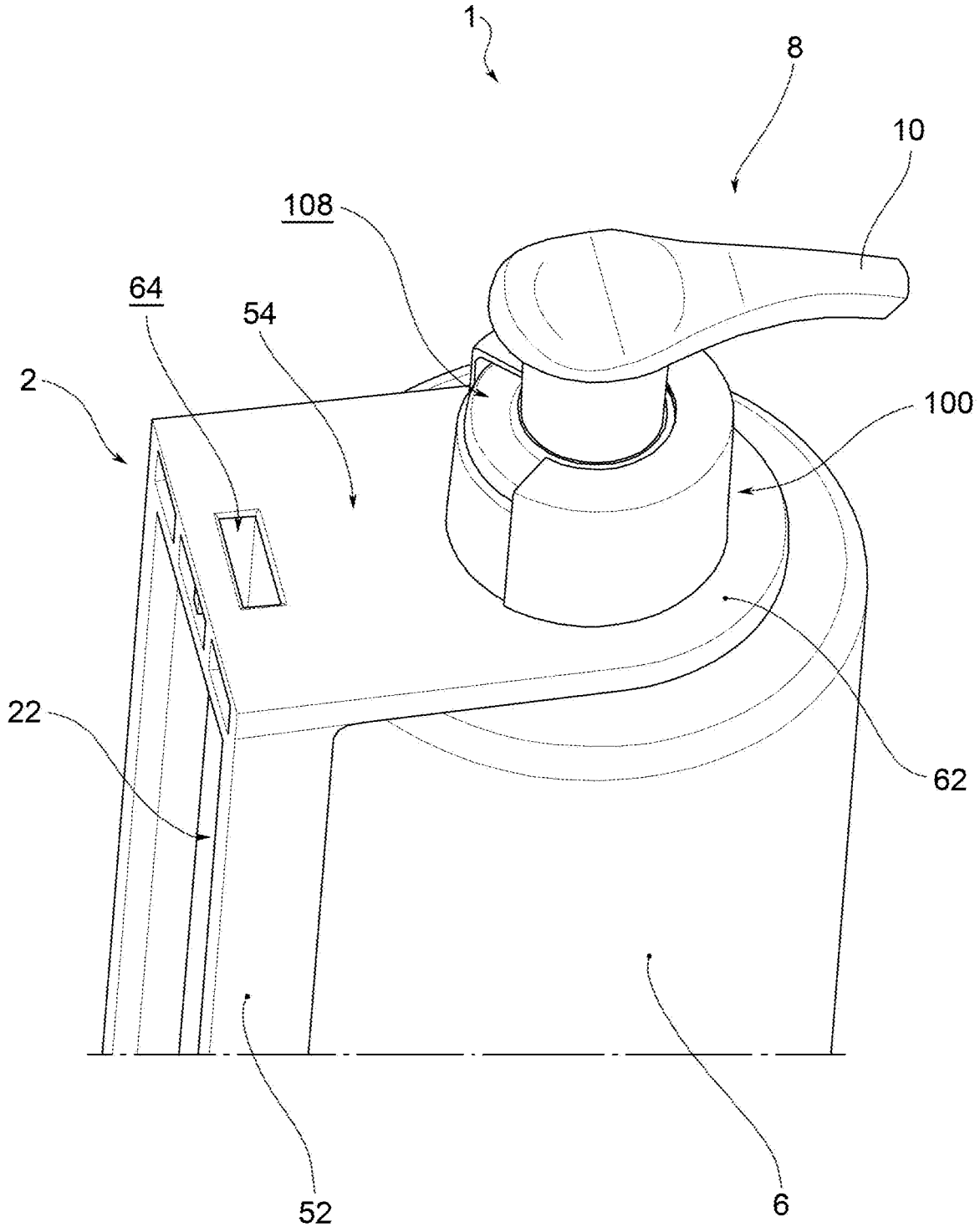
FIG. 6*a* illustrates the dispensing unit according to the present invention, in accordance with a further embodiment.
Figure 6B:
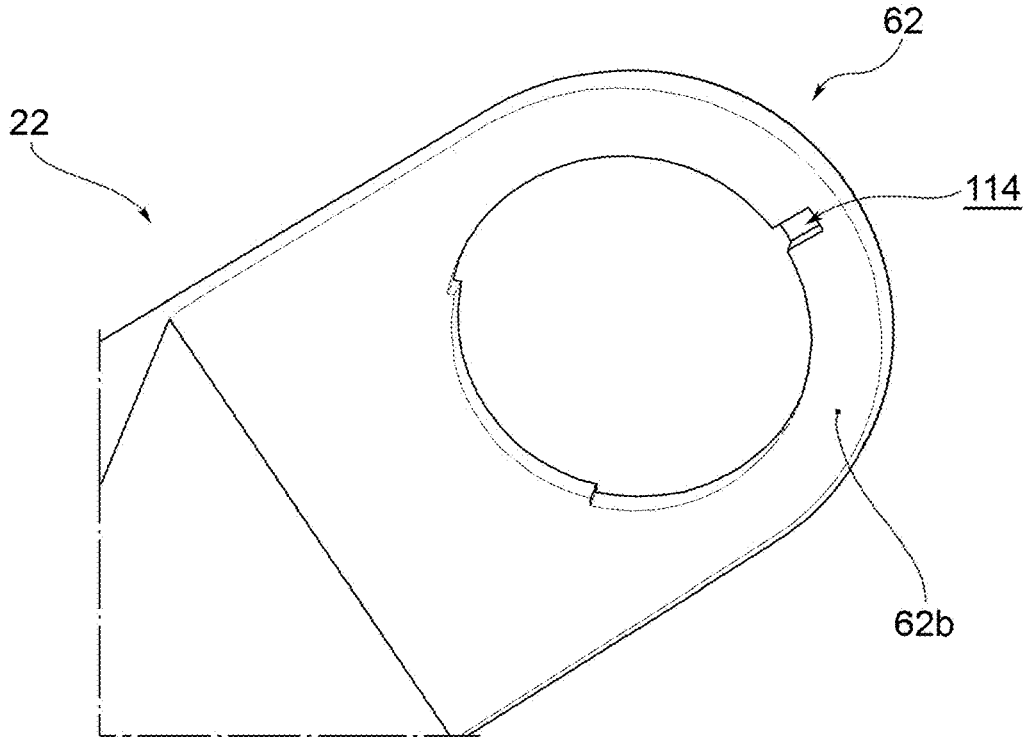
FIG. 6*b* illustrates a support device for the dispensing unit of FIG. 6*a;*
Figure 6C:
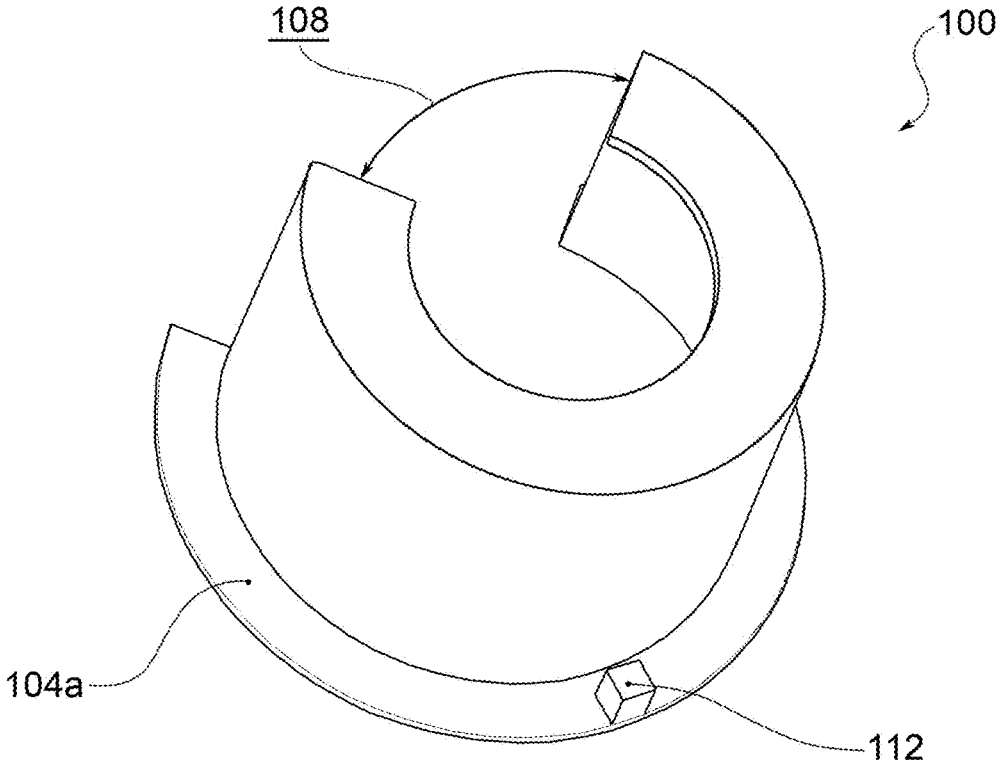
FIG. 6*c* represents a security collar of the dispensing unit of FIG. 6*a;*
Figure 7A:
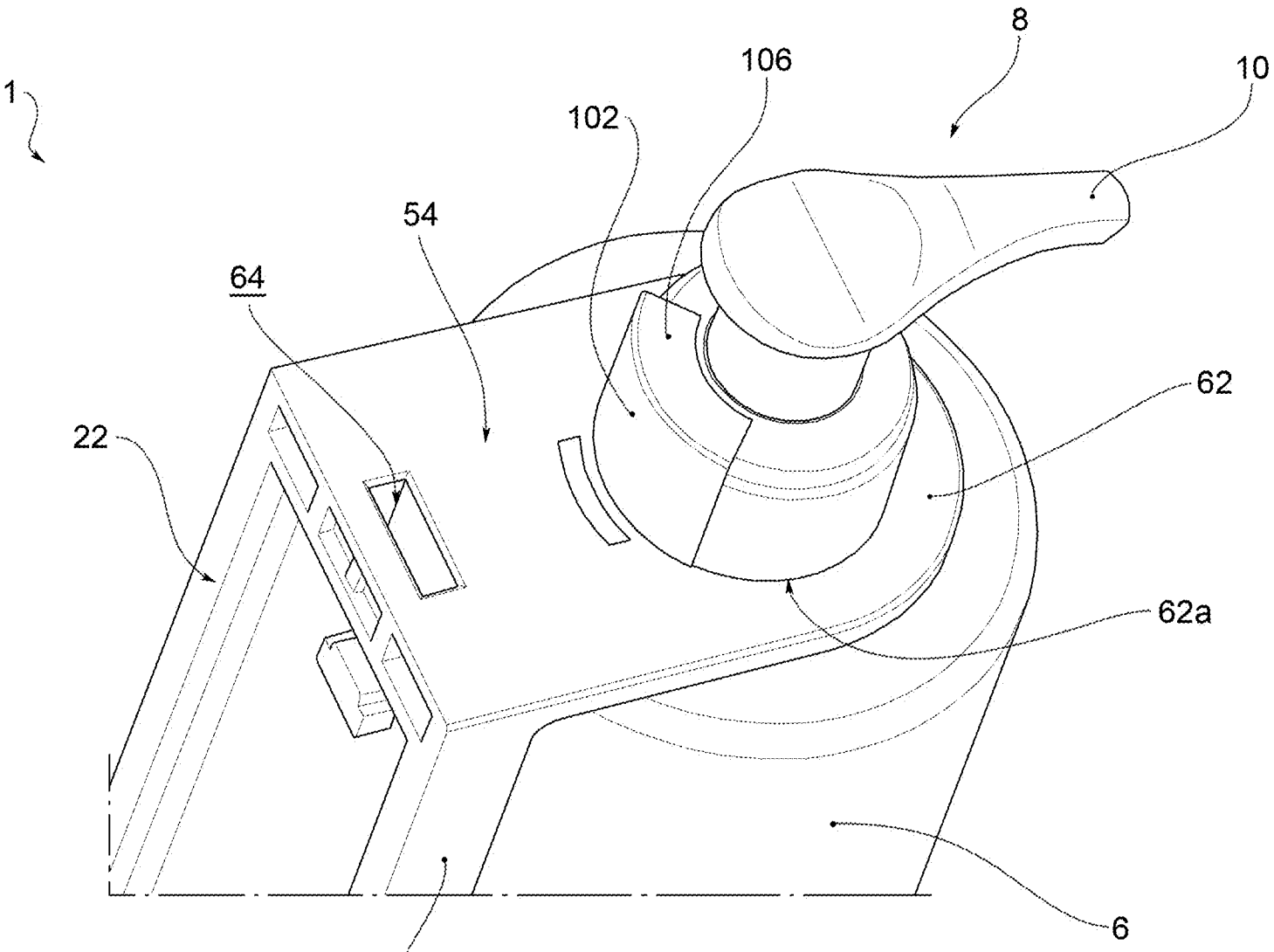
FIG. 7*a* illustrates the dispensing unit according to the present invention, in accordance with a further embodiment.
Figure 7B:
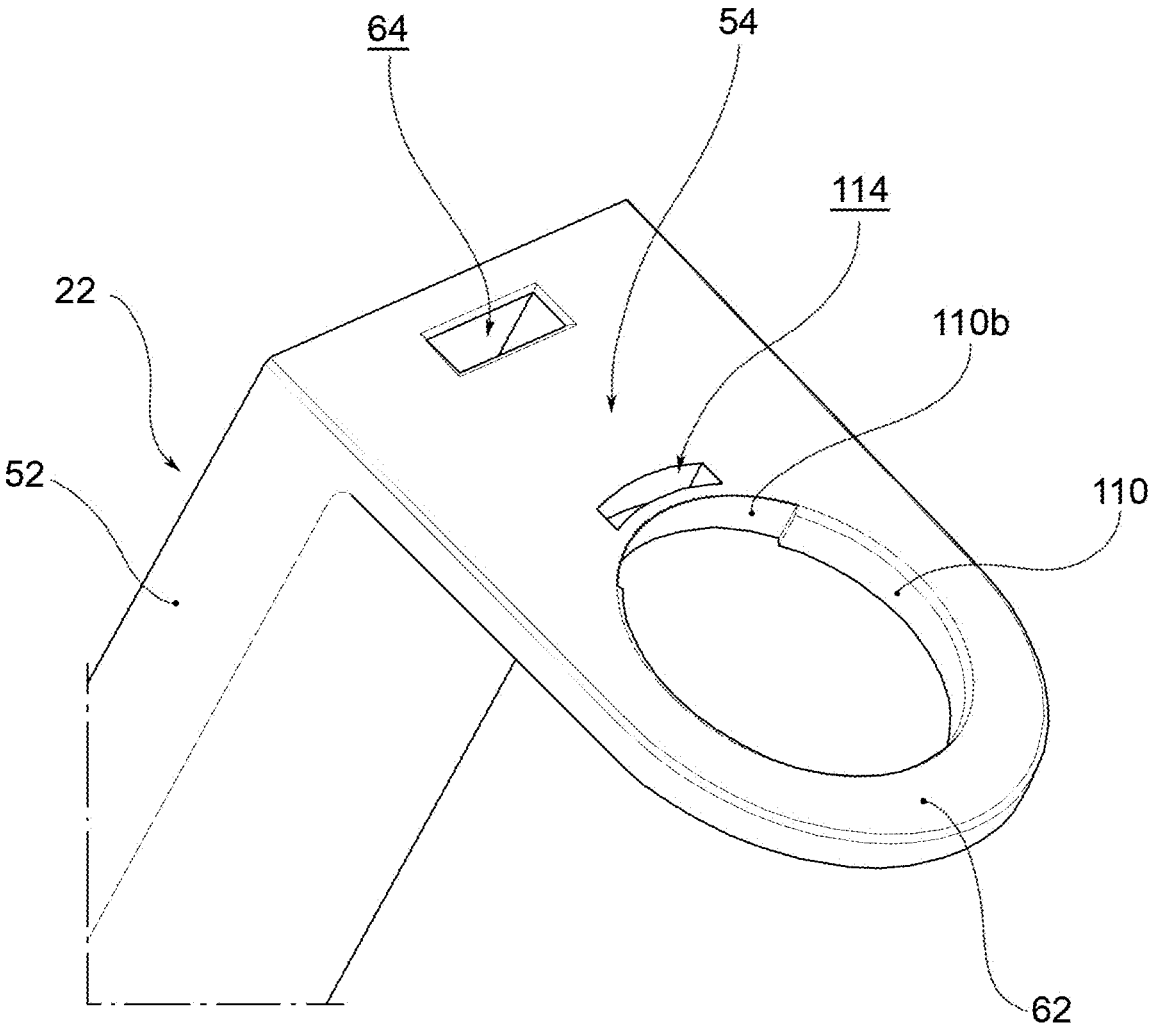
FIG. 7*b* illustrates a support device for the dispensing unit of FIG. 7*a;*
Figure 7C:
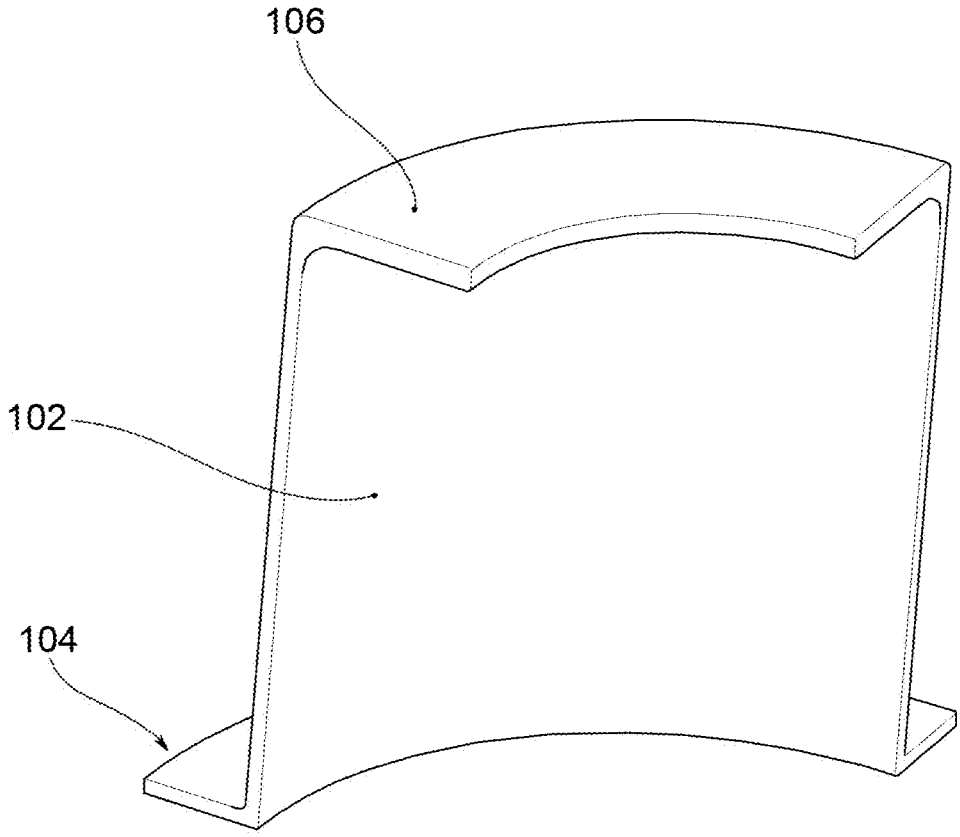
FIGS. 7*c* and 7*d* represent a security collar of the dispensing unit of FIG. 7*a*.
Figure 7D:
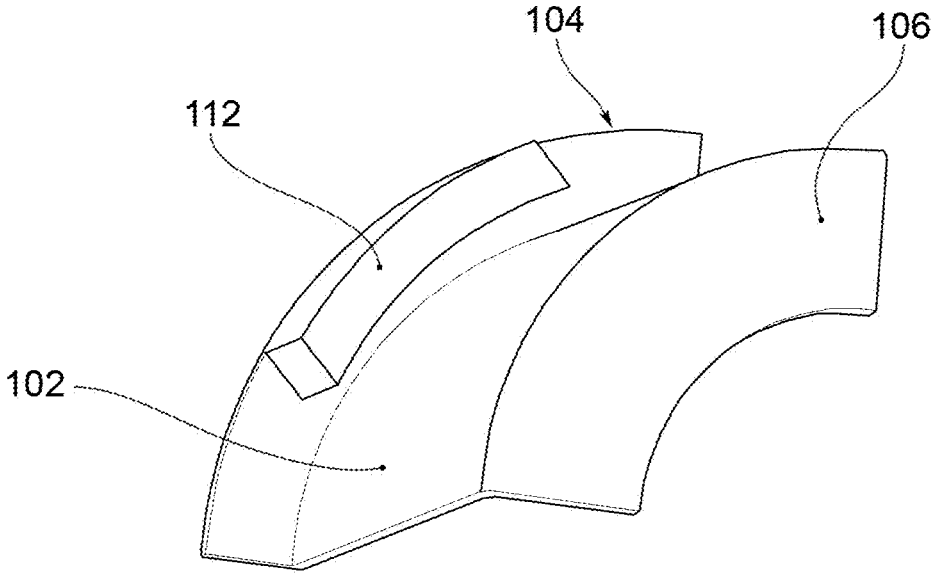

Moreover, the security projection 112 has greater angular extension than in the embodiment shown in FIGS. 6*a* to 6*c* and the gripping seat 114 passes through the thickness of the gripping collar 62.

Moreover, the gripping projection 110 extends over most of the angular extension of the gripping opening 62*a*, so that the security wall 102 may be inserted into the remaining space 110*b*.

In this embodiment, the engagement region between the dispensing head 8 and the bottle 6 may be reached by a user, but in any case, the dispensing head 8 is not separable from the bottle 6 by virtue of the retention enacted by the security crown 106.

Innovatively, the dispensing unit 1 according to the present invention meets the needs of the sector and overcomes the drawbacks mentioned with reference to the prior art because the dispenser may no longer be unscrewed and unlawfully removed, as it is blocked at the top by the collar and below by the coupling with the engagement projection.

Moreover, the bottle is exposed as well as the label, so that the user may be informed about the nature of the product to be dispensed and the composition. In other words, between the foot 30 and the gripping collar 62 a compartment is defined for the reception of the bottle and the compartment is free of panels, so as to leave the bottle exposed.

Advantageously, moreover, by properly configuring the engagement projection and the cavity, a univocal match is created between the dispenser and the support device, so that each dispenser may be coupled to a respective support device, in such a way that the service personnel may distribute the various products without making mistakes.

Another advantage of the dispensing unit according to the present invention is that it allows one to limit the use of counterfeit dispensers and products which are at times dangerous, because only dispensers containing original products have a cavity corresponding to a predefined engagement projection.

Advantageously, moreover, by modifying the aesthetics of the dispenser bottle alone, the aesthetics of the entire dispensing unit are modified. This is particularly appreciated, for example, by hoteliers, who may introduce new elements into the aesthetics of a room by changing the aesthetics of the bottle alone.

Furthermore, the support device may be mounted to the wall by means of screws or anchors or by means of double-sided adhesive tape; advantageously, this allows an application to the wall according to various needs.

According to an even more advantageous aspect, the dispensing unit provides that the dispensing head is separable from the bottle only by the staff in charge of the arrangement of the hotel rooms, equipped with the release key, while it is not separable by the users.

It is clear that one skilled in the art, in order to meet contingent needs, may make changes to the dispensing unit described above, all contained within the scope of protection as defined by the following claims.

The invention claimed is:

1. A support device mountable to a wall to support a dispenser comprising a bottle and a dispensing head coupled in an engagement region, the support device comprising:

a mounting body comprising a mounting plate, configured to be mounted to the wall, and a foot projecting from the mounting plate, wherein the foot comprises an upper surface and an engagement projection protruding from the upper surface;

a covering body comprising a cover, configured to at least partially cover the mounting plate, and a gripping portion, projecting from the cover and comprising a gripping collar engageable with the dispenser, wherein the covering body is slidably coupable to the mounting body, wherein a compartment for accommodating the bottle is defined between the foot and the gripping collar; and hooking means configured to obtain a snap engagement between the covering body and the mounting body, said hooking means being releasable and comprising an opening obtained through the covering body, configured to insert a key for releasing the hooking means;

wherein the engagement projection has a predefined configuration for univocally coupling with a bottom of the bottle of the dispenser; and wherein said compartment of the support device is not fully enclosed, so as to leave the bottle visible.

2. The support device of claim 1, wherein said hooking means comprise a flexible fork of the mounting plate and a hooking element of the cover.

3. The support device of claim 1, wherein the mounting plate comprises a pair of lateral sides and the cover comprises a pair of lateral guides each lateral guide having an undercut, wherein said lateral guides are slidably coupable to the lateral sides, until the lateral sides and the lateral guides reach a configuration of engagement where said hooking means are engaged.

4. The support device of claim 1, comprising a security collar applicable to the gripping collar so as to be axially bound to the gripping collar, said security collar comprising a security crown suitable to at least partially cover the engagement region between the dispensing head and the bottle to prevent a separation of the dispensing head from the bottle.

5. The support device of claim 1, comprising a security collar applicable to the gripping collar, said security collar comprising a security wall suitable to at least partially cover the engagement region between the dispensing head and the bottle to prevent access to said engagement region by a user.

6. A bottle for a dispenser, the bottle comprising a bottom provided with a cavity for univocal coupling with a support device of the dispenser, wherein said cavity has a frustoconical shape, made at the center of the bottom of the bottle.

7. A dispenser, comprising:

a bottle according to claim 6; and a dispensing head applied to the bottle and manually operable for dispensing a product contained in the bottle.

8. A dispensing unit, comprising:

a support device according to claim 1;

a dispenser comprising:

a bottle for a dispenser, the bottle comprising a bottom provided with a cavity for univocal coupling with the support device, wherein said cavity has a frustoconical shape, made at the center of the bottom of the bottle; and a dispensing head applied to the bottle and manually operable for dispensing a product contained in the bottle.

* * * * *